United States Patent [19]

Schepler

[11] 4,039,236

[45] Aug. 2, 1977

[54] MODULAR BREADBOARD

[76] Inventor: Kent L. Schepler, 1103 Oak St., Apt. D, Canon City, Colo. 81212

[21] Appl. No.: 677,564

[22] Filed: Apr. 16, 1976

[51] Int. Cl.[2] ..... H01R 29/00

[52] U.S. Cl. ..... 339/17 N; 339/18 B; 339/198 R; 361/400

[58] Field of Search ..... 339/17 N, 18 R, 18 B, 339/150 B, 150 T, 198 R; 35/19 A; 317/101 CC; 324/158 F

[56] References Cited

U.S. PATENT DOCUMENTS

| | | | |
|---|---|---|---|
| 3,327,278 | 6/1967 | Godel | 339/18 B |
| 3,335,388 | 8/1967 | Karol | 339/18 B |
| 3,410,001 | 11/1968 | Blum | 339/18 B |
| 3,488,628 | 1/1970 | Lundergan | 317/101 CC |
| 3,564,480 | 2/1971 | Dziubaty | 339/18 R |
| 3,832,603 | 8/1974 | Cray | 317/101 CC |

*Primary Examiner*—Roy Lake
*Assistant Examiner*—Mark S. Bicks
*Attorney, Agent, or Firm*—Oliver E. Todd, Jr.

[57] ABSTRACT

An improved modular breadboard for temporarily mounting and interconnecting electrical components to form an electronic circuit. The breadboard includes two panel assemblies which are mounted on leg brackets to extend parallel and spaced apart. Modules mounting preselected circuit components or circuit subassemblies are releasably locked between the panel assemblies with spring loaded fingers on one or both of the panel assemblies. The modules and the panel assemblies are provided with a plurality of solderless spring terminals and binding posts for temporarily connecting wires and circuit components to form the experimental circuit.

8 Claims, 9 Drawing Figures

MODULAR BREADBOARD

BACKGROUND OF THE INVENTION

This invention relates to apparatus for wiring electrical circuits and more particularly to an improved modular breadboard for temporarily mounting and interconnecting electrical components to form an electronic circuit.

Newly designed and experimental electrical circuits commonly are tested by temporarily constructing the circuit on a breadboard. Generally, circuit elements are either mounted directly on the breadboard or attached to the breadboard by means of lead wires which are connected to terminals mounted on the breadboard. Two basic types of terminals commonly are used on prior art breadboards. On one type of terminal, connections are made by soldering circuit component leads and wires interconnecting circuit components to terminal posts. Solder terminals are relatively permanent and the connections will withstand considerable vibrations and other stresses before failure. However, it is time-consuming and difficult to change circuit connections when the circuit or a circuit component is modified. Considerable time is also required to disassemble the circuit after it is tested and no longer needed if the circuit components are to be salvaged. A second type of terminal, which is solderless, releasably holds component leads and wires to facilitate rapid circuit assembly, rapid circuit modification and rapid circuit disassembly after the circuit is tested and no longer needed. Typical solderless terminals are shown, for example, in U.S. Pat. No. 3,150,911 which issued to Matteson on Sept. 29, 1964 and U.S. Pat. No. 3,564,480 which issued to Dziubaty on Feb. 16, 1971. These patents disclose solderless terminals consisting of a helical tension spring mounted in a housing. The housing either is stamped to form four upstanding fingers which are spaced around the spring or is molded from a synthetic resinous material. When an outer end coil on the spring, which forms a handle, is pulled, the spring coils are separated to receive wires and/or circuit component leads. The handle is then released and the spring retracts to clamp onto the wires and/or component leads, thereby completing the circuit.

Prior art terminals suitable for use on breadboards are connected to breadboards by various methods. The solderless terminal shown in U.S. Pat. No. 3,150,911 is assembled and attached to a breadboard by means of either a woodscrew or a bolt passed through an inner end coil of the spring and the retainer housing. The strength of the bolt or screw is limited since the head of the bolt or screw must fit within the spring and housing. This in turn limits the strength of the attachment between the terminal and the breadboard. Another type of terminal has an end adapted to be pushed into a hole drilled into the breadboard. This type of terminal typically is held in place either by friction with a press fit into the hole or with one or more detents formed on the terminal for engaging the breadboard.

When constructing circuits on a breadboard, it sometimes is desirable to use prewired circuit modules containing circuit subassemblies such as an amplifier circuit or circuit components such as sockets for integrated circuits, transistors, tubes, relays and the like. U.S. Pat. No. 3,514,872, which issued June 2, 1970 to Bradley, discloses a breadboard assembly having a grid of spaced electrically conductive terminals. Rectangular circuit modules are positioned between and electrically contact four of the terminals located on the breadboard for cooperating with terminals on the corners of the modules. This arrangement permits rapid connection of the modules to the breadboard in constructing a circuit. However, only a limited number of circuit connections may be made to a module since each rectangular module has only four terminals. Furthermore, connections are made only between adjoining modules since there is no provision for connecting wires to the terminals. U.S. Pat. No. 3,633,074, which issued Jan. 4, 1972 to Nojiri, shows a similar breadboard construction in which terminals on circuit modules plug into openings in a board. Electrical contact is made between such terminals and abutting terminals on adjacent modules inserted into the same openings. The breadboard constructions disclosed in both of these patents are suitable only for assembling relatively simple circuits having a limited number of connections.

SUMMARY OF THE INVENTION

According to the present invention, an improved modular breadboard assembly is provided for temporarily mounting and interconnecting electrical components to form an electronic circuit. The breadboard includes two panel assemblies which are mounted on leg brackets to extend in a parallel and spaced apart relationship. The panel assemblies are mounted coplanar and are adapted to receive circuit modules therebetween, which modules mounted preselected circuit components such as circuit subassemblies, sockets for integrated circuits, transistors or tubes, relays, transformers, and the like. Each panel assembly includes two flat boards formed from an electrically insulating material and separated by spacers to form a groove along the edge for receiving the modules. Spring biased fingers, provided within the space between the boards on at least one of the panel assemblies, are biased toward the other panel assembly. Modules containing preselected circuit components are inserted onto the breadboard by inserting one edge within the module groove on a panel assembly having the spring biased fingers and pushing against such fingers. The opposite edge of the module is then dropped into alignment with the module groove on the other panel assembly and the module is released. The spring biased fingers then hold the module between the two panel assemblies, preventing the modules from freely sliding along the grooves, and allowing easy removal of the module without disturbing other modules which may have been previously inserted into the breadboard.

Each of the panel assemblies is provided with a plurality of rows of spaced solderless spring terminals for temporarily interconnecting wires and circuit component leads to form electronic circuits. Spring terminals are also provided on the modules. The spring terminals may be of any conventional design for releasably receiving and electrically interconnecting a plurality of wires and leads to various circuit components such as resistors, transistors, diodes, capacitors and the like. In one embodiment, the spring terminals include a housing formed from either extruded metal bar stock or shaped from a flat sheet of metal to define a cylindrical opening with slots formed along the sides of the opening. A helical tension spring is retained within the cylindrical opening and has an exterior end deformed or shaped to form a handle. In operation, the handle on the end of the spring is lifted to separate the spring coils and wires and component leads are then inserted through the housing slots and between the spring coils. The spring is then released to resiliently engage and hold the wires and leads, thereby electrically interconnecting such wires and leads. Preselected ones of the spring terminals on one or both panel assemblies may be electrically interconnected for forming a common bus, such as a common electrical ground bus.

The modular breadboard of the present invention provides a matrix or grid of solderless terminals on two sides of the opening which receives the modules. The solderless terminals permit rapid connection to and between the individual modules and other circuit components. In addition, a plurality of the modular breadboards may be stacked or placed end-to-end and interconnected to form complicated circuits involving a large number of components. In designing and preparing a circuit for production, each individual breadboard may, for example, contain the circuit components which will eventually be mounted on a single card or printed circuit board when the experimental circuit is finally put into production. The individual boards forming each panel assembly are designed such that a printed circuit may be formed on the backs of the boards without electrically contacting the individual terminals. The printed circuit electrically shields the circuit assembled on the breadboard, which may be important especially when a plurality of the modular breadboard assemblies are stacked.

Accordingly, it is an object of the invention to provide an improved breadboard for temporarily mounting and interconnecting electrical components to form an electronic circuit.

Another object of the invention is to provide a modular breadboard adapted to releasably receive modules containing either circuit subassemblies or predetermined circuit components.

Other objects and advantages of the invention will become apparent from the following detailed description, with reference being made to the accompanying drawings.

DESCRIPTION OF THE PREFERRED EMBODIMENTS

Figure 1:
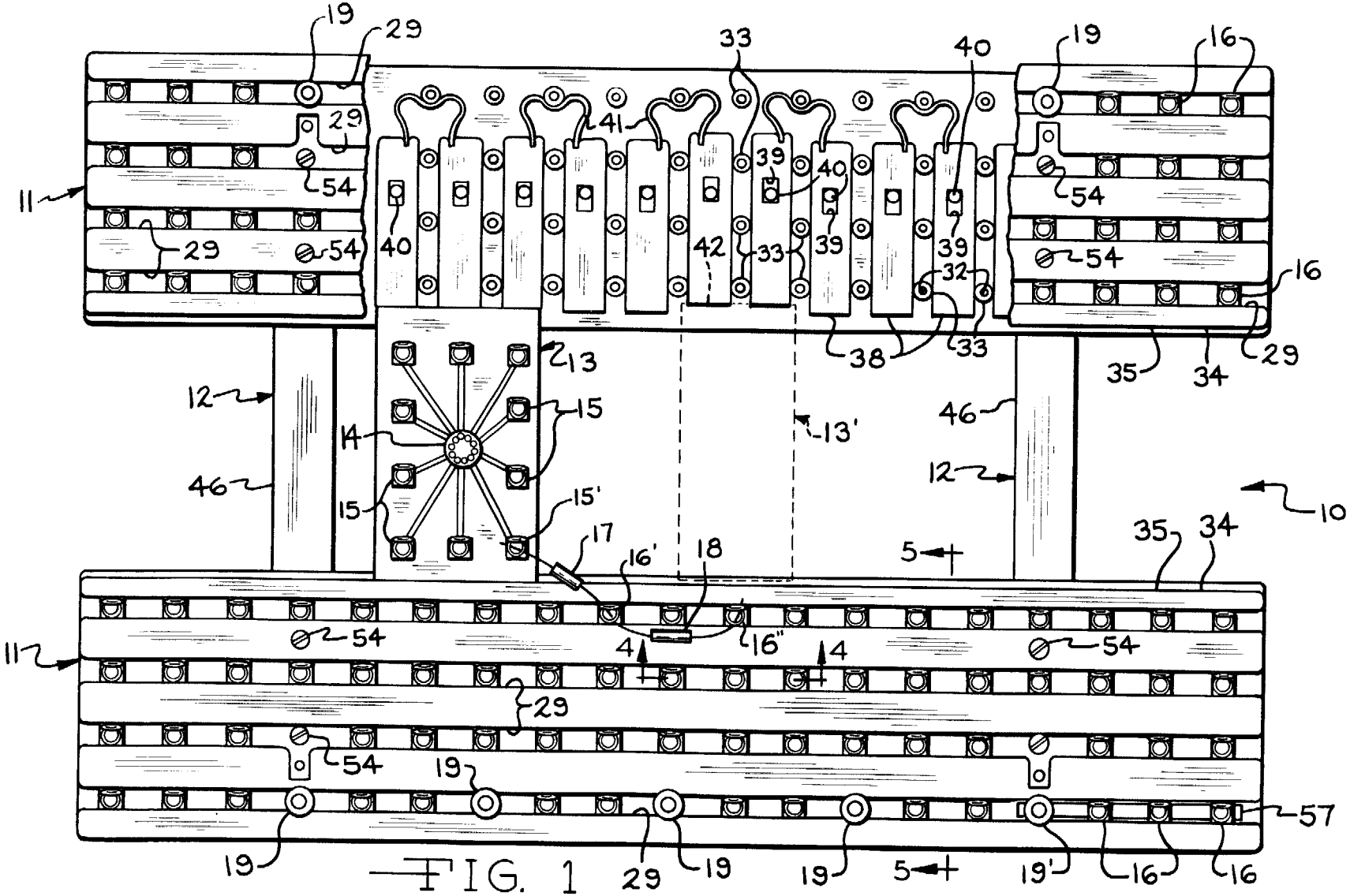
FIG. 1 is a top plan view, partially broken away, of a modular breadboard constructed in accordance with a preferred embodiment of the invention.
Figure 2:
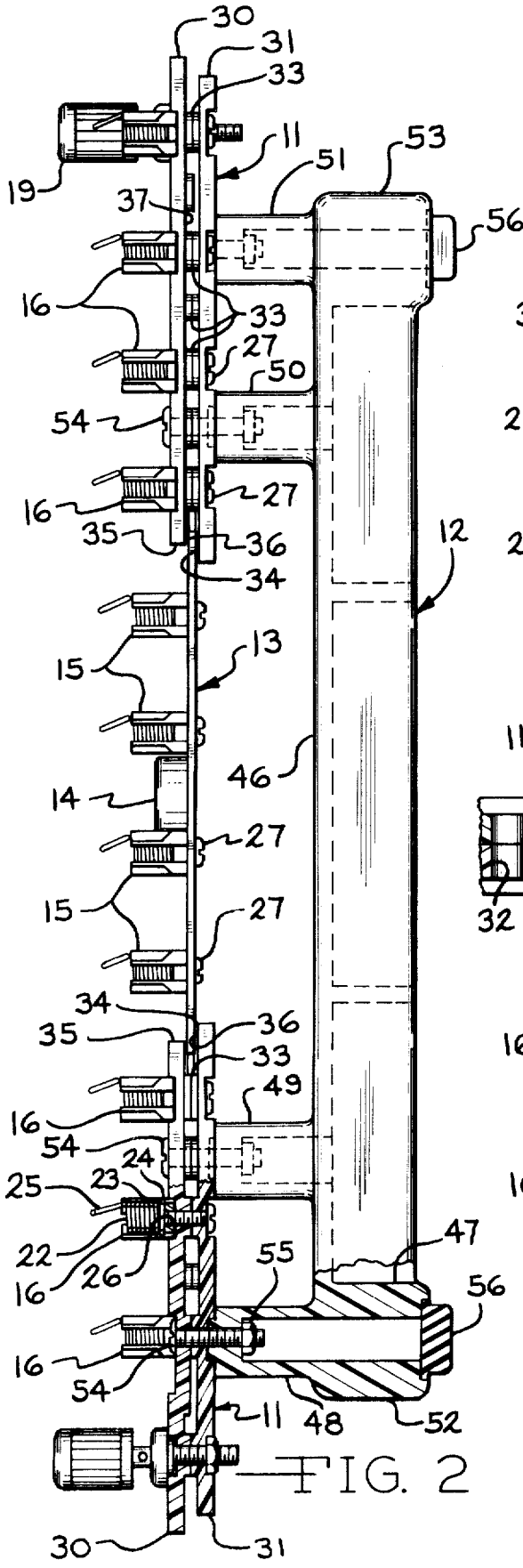
FIG. 2 is an end elevational view, in partial section, of the modular breadboard of the present invention.

Turning now to the drawings and particularly to FIGS. 1 and 2, a modular breadboard 10 is shown constructed in accordance with the present invention for use in temporarily mounting and interconnecting electrical components to form an electrical circuit. The modular breadboard 10 generally comprises two panel assemblies 11 mounted on two leg brackets 12. The panel assemblies 11 are generally of an elongated rectangular configuration, in plan, and are attached to the leg brackets 12 to extend parallel and spaced apart for releasably receiving one or more modules 13 therebetween. Each module 13 mounts either a circuit subassembly or one or more predetermined circuit components, such as a socket 14 for an integrated circuit, a socket for a transistor or tube, a relay, a transformer, or the like. The module 13 includes a plurality of solderless terminals 15 which are electrically connected to the socket 14 or other electrical component or circuit subassembly on the module 13.

Each of the two panel assemblies 11 mounts a plurality of solderless terminals 16 arranged in columns and rows to form a grid or matrix. The individual terminals 15 and 16 are electrically insulated from each other and are adapted to releasably engage wires and leads from components such as resistors, capacitors, transformers and the like. An exemplary resistor 17 is shown connected between a preselected terminal 15' on the module 13 and a terminal 16' on one of the panel assemblies 11. A capacitor 18 is then shown connected from the terminal 16' to another terminal 16''' on the same panel assembly 11. The solderless terminal 16' electrically interconnects the leads from the resistor 17 and the capacitor 18 to form a portion of an electric circuit. At the same time, the leads from the resistor 17 and capacitor 18 are electrically insulated from the other terminals 16 on the panel assembly 11. Each panel assembly 11 also includes a plurality of binding posts 19 for making electrical connections from the circuit assembled on the modular breadboard 10 to external components or elements, such as a battery or power supply, input devices such as antennas, microphones, signal generators and the like and output devices such as meters, speakers and the like. The particular connection made to any of the binding posts 19 is determined by the actual circuit assembled on the modular breadboard 10.

Figure 3:
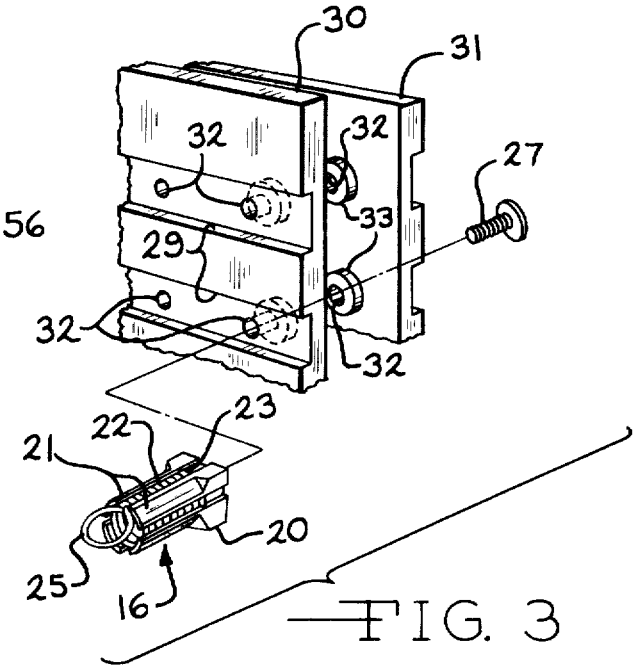
FIG. 3 is an exploded fragmentary view of a corner of a panel assembly for the modular breadboard of the present invention showing a method for attachment of the spring terminals.
Figure 4:
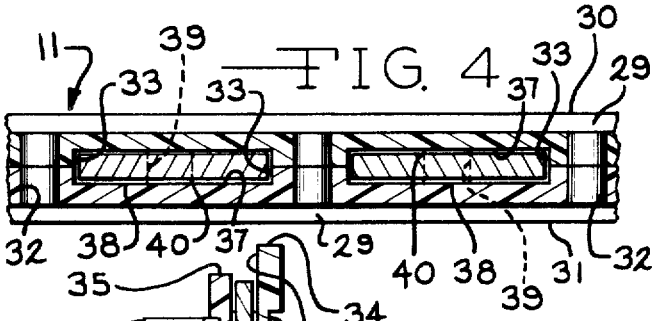
FIG. 4 is a cross-sectional view taken along line 4–4 of FIG. 1.
Figure 5:
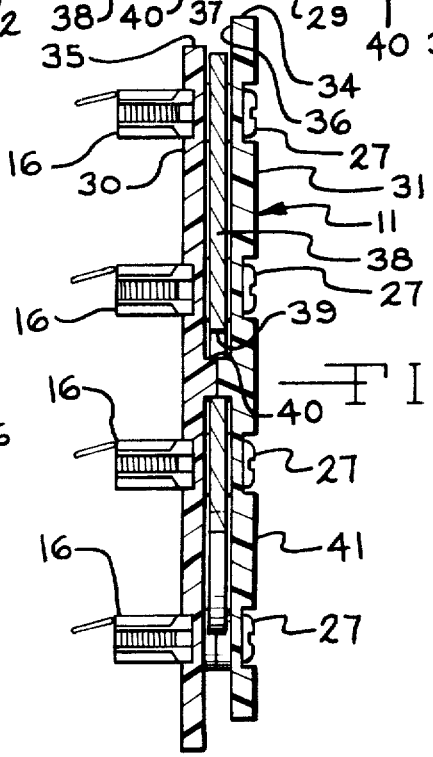
FIG. 5 is a cross-sectional view taken along line 5—5 of FIG. 1.

The terminals 15 and 16 may be of any suitable design capable of releasably receiving and electrically interconnecting a plurality of wires or component leads. For example, the terminals may be of the type disclosed in the above-mentioned U.S. Pat. No. 3,150,911 which consists of a housing having four upstanding legs spaced for receiving a helical tension spring therebetween. A lower or inner coil of the spring receives the head of a screw for attaching the spring and housing to one of the panel assemblies 11 or to the module 13, while an upper or outer coil on the spring is bent to define a handle. In operation, the handle is manually pulled to extend the spring and wires are inserted between the upstanding housing legs and the separated spring coils. When the handle is then released, the spring retracts to engage and electrically contact the wire. A similar, but improved, terminal construction is shown in detail in FIGS. 2 and 3. The terminal 16 includes a housing 20 formed from extruded bar stock of metal such as brass or aluminum. The housing 20 is machined to define four upstanding legs 21 which surround an opening in which a helical tension spring 22 is located. An innermost coil 23 on the spring 22 is retained within an annular groove 24 formed within the housing 20, while an outer spring coil 25 is bent to form a handle. The housing also includes a threaded opening 26 for attachment to a panel assembly 11 or a module 13. A screw 27 is passed through either a panel assembly 11 or a module 13 and threaded into the opening 26 for attaching the terminal 15 or 16 to the modular breadboard 10. Wires are then attached to the terminal 15 or 16 merely by pulling on the handle 25 to extend the spring 22 and inserting such wire between any two coils of the extended spring 22. When the handle 25 is released, the spring 22 firmly engages and electrically contacts the wire for forming an electrical connection. It should be appreciated that alternate fastening means such as a rivet, or stud extending from the housing 20, may be used to attach the terminal 15 or 16 to the modular breadboard.

Referring now to FIGS. 1, 2, 4 and 5, details are shown for the panel assemblies 11. Each panel assembly 11 includes an upper board 30 and a lower board 31 which are attached together by the screws 27 which mount the terminals 16 on the panel assembly 11. The screws 27 are passed through openings 32 which extend through the upper board 30 and the lower board 31 and bosses 33 molded integrally on the interior surface of the upper and lower boards 30 and 31. Channels 29 are formed on the upper board 30 to prevent the terminals 16 from rotating during initial assembly and subsequent use of the modular breadboard 10. Preferably, the upper board 30 and the lower board 31 are identical moldings from an electrically nonconducting synthetic resinous material, such as an epoxy, nylon, or the like. The boards 30 and 31 may be reinforced with glass fibers or by any other conventional means, when strength is required in the panel assembly 11. The identical moldings forming the boards 30 and 31 are then inverted with respect to each other so that when the bosses 33 on the boards 30 and 31 are placed together with the openings 32 aligned, the lower board 31 forms a lip 34 at one edge which projects past a lip or edge 35 of the upper board 30. The panel assemblies 11 are mounted on the leg brackets 12 such that the lips 34 on the lower boards 31 of the two panel assemblies 11 project towards each other. The lips 34 function to align the modules 13 with a module groove 36 defined between the upper board 30 and the lower board 31.

The bosses 33 space the upper board 30 and the lower board 31 to form openings 37 therebetween for receiving a plurality of flat, elongated fingers 38. Each of the fingers 38 has a rectangular opening 39 which is positioned over a boss 40 on one or both of the upper and lower boards 30 and 31. The bosses 33 and the boss 40 cooperate to limit each finger 38 to movement in a longitudinal direction towards and away from the module groove 36 on the opposite panel assembly 11. A spring 41 extends over one of the bosses 33 between an adjacent pair of the fingers 38 for biasing such fingers towards the module groove 36 on the opposite panel assembly 11. Each finger 38 may be moved against its spring 41 a limited distance, in a longitudinal direction, as determined by the rectangular opening 39 and the boss 40. The fingers 38 function to permit insertion of one or more modules 13 in the modular breadboard 10 and, subsequent to insertion, function to hold such modules 13 firmly in place.

Figure 6:
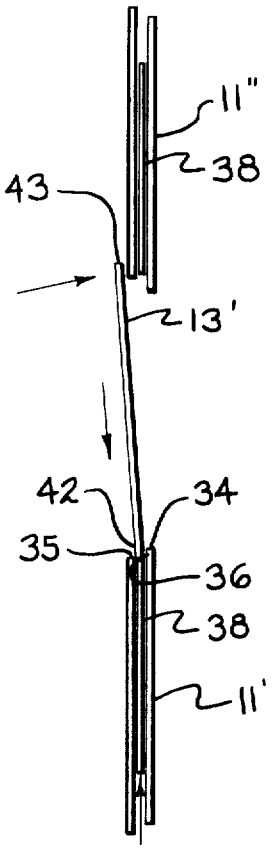
FIG. 6 is a pictorial end elevational view showing a first step in inserting a module into the modular breadboard of the present invention.
Figure 7:
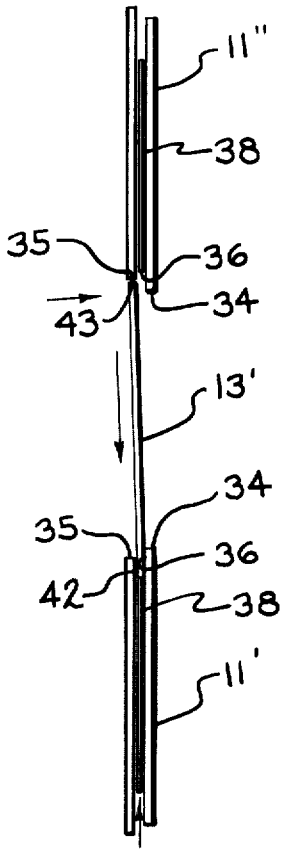
FIG. 7 is a pictorial end elevational view showing a second step in inserting a module into the modular breadboard of the present invention.
Figure 8:
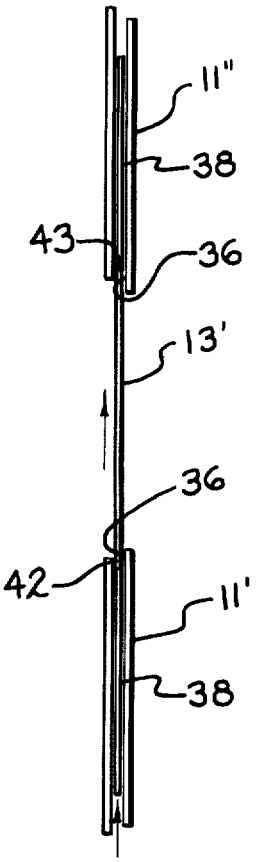
FIG. 8 is a pictorial end elevational view showing a third and final step in inserting a circuit module into the modular breadboard of the present invention.

Turning to FIGS. 6–8, the manner in which the modules 13 are installed in the modular breadboard 10 is shown pictorially. An edge 42 of an exemplary module 13' is inserted within the module groove 36 in one of the panel assemblies 11', as shown in FIG. 6. The module 13' is then forced into the groove 36 in the panel assembly 11', moving one or more of the spring biased fingers 38, until an opposing edge 43 clears the edge 35 of the opposing panel assembly 11'', as shown in FIG. 7. The edge 43 is then moved inwardly until it is free to pass into the module groove 36 in the panel assembly 11''. The module 13' is then released and becomes centered between the panel assemblies 11' and 11'', as shown in FIG. 8. It should be noted that although the panel assembly 11'' has spring biased fingers, the fingers 38 are only needed in the panel assembly 11' to permit insertion of the module edge 43 into the module groove 36 in the panel assembly 11''. In a modified embodiment of the invention, the fingers 38 in the panel assembly 11'' may be replaced with stops for positioning the module end 43 in the groove 36 of the panel assembly 11''. Or, both of the panel assemblies 11' and 11'' may be provided with the spring fingers 38 so that the module end 42 may be inserted into the module groove 36 in either of the panel assemblies 11' or 11''.

Figure 9:
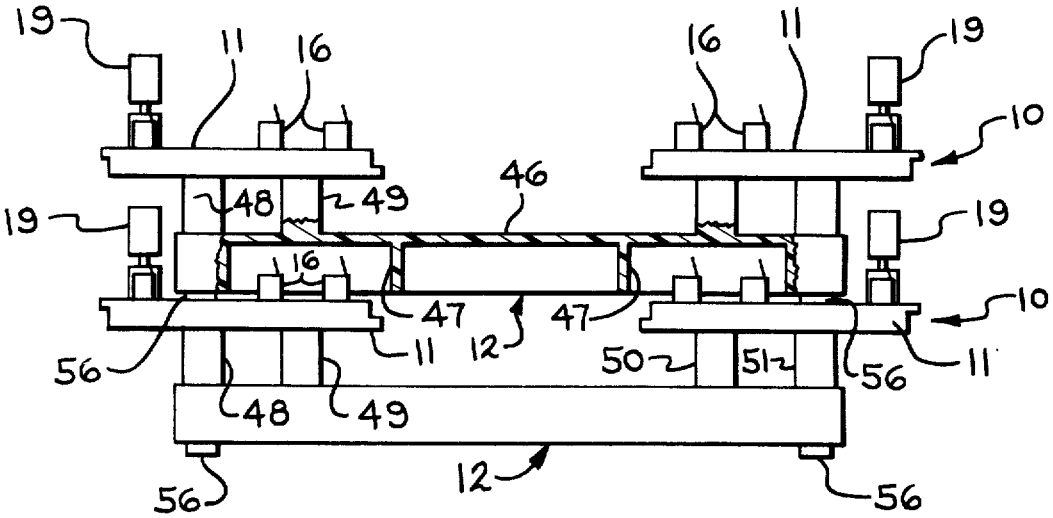
FIG. 9 is a pictorial end view, in partial section, showing two modular breadboards of the present invention stacked.

Referring to FIGS. 2 and 9, details are shown on the leg brackets 12. Each leg bracket 12 includes an open channel-shaped section 46 which extends between the two spaced panel assemblies 11 and has one or more downwardly facing openings 47. Four posts 48–51 project upwardly from the channel section 46 with two of the posts 48 and 49 adjacent one end 52 for attachment to one of the panel assemblies 11 and the other two posts 50 and 51 adjacent an opposite end 53 for attachment to the other of the panel assemblies 11. Screws 54 are passed through the panel members 11 and either threaded into the posts 48–51 or attached to nuts 55 located within the posts 48–51 for mounting the panel assemblies 11 on the leg brackets 12. Feet 56 formed from natural rubber or a resilient synthetic resinous material are attached to the leg brackets 12 below the posts 48 and 51. When a plurality of the modular breadboards 10 are stacked, as is shown in FIG. 9, the feet 56 will rest upon the panel assemblies 11 of an adjacent, lower breadboard 10. The opening 47 within the leg bracket channel section 46 is adapted such that when a modular breadboard 10 is stacked upon a similar modular breadboard 10, terminals 16 of the lower modular breadboard 10 will fit within the opening 47 to prevent interference between the stacked breadboards 10. In some cases, it is desirable or necessary to electrically shield the circuit mounted on the breadboard assembly 10. This may be particularly critical where a plurality of the modular breadboards 10 are stacked, as shown in FIG. 9. Shielding may be readily provided on the panel assemblies 11 by depositing or otherwise attaching a metallic layer or foil on the interior of either the upper board 30 or the lower board 31 to cover the entire inner surface of such board 30 or 31, except for the bosses 33. The bosses 33 function to insulate the screws 27 mounting the terminals 16 from such foil. However, preselected ones of the terminals 16 may be connected to the deposited metallic film or conductor to provide ground connections for a circuit mounted on the modular breadboard 10. In addition, a strip of electrically conductive foil may be positioned in a portion of the channels 29 for interconnecting preselected ones of the terminals 16 and the binding posts 19. An exemplary strip of foil 57 is shown in FIG. 1 interconnecting three of the terminals 16 and a binding post 19'. These common terminals may be used, for example, as ground connections and may also be connected to any shielding foil deposited on the interior of the upper board 30 or the lower board 31.

It will be appreciated that various modifications and changes may be made in the above-described exemplary embodiment of the modular breadboard 10 without departing from the spirit and the scope of the following claims. For example, in the modular breadboard 10 described above, it has been stated that at least one of the two panel assemblies 11 is provided with the spring biased fingers 38 to permit inserting the module 13 into the module groove 36 on the two panel assemblies 11. The module 13 is shown as consisting of a flat board which fits within the module receiving grooves 36. In a modified embodiment, the panel assemblies could be replaced with single flat boards formed from electrically insulating material such as a synthetic resinous material. In this case, the module would be formed from two spaced board-like members having parallel, outwardly facing grooves on opposite sides for receiving the panel assemblies. Spring biased fingers would then be provided between the boards forming the module. Such fingers would be biased to extend into at least one of the grooves to permit insertion of the module onto the panel assemblies. The module may be designed, for example, to have a cross section similar to that shown in FIGS. 4 and 5 for the panel assemblies 11. It should also be appreciated that the springs 41 may be replaced with other well known types of springs such as helical springs or a spring formed from a block of resilient material. Various other changes and modifications in the modular breadboard of the present invention will also be apparent to those skilled in the art.

What I claim is:

1. A modular breadboard assembly on which electrical circuits are constructed comprising, in combination, a pair of panel assemblies each having an edge, support means rigidly mounting said panel assemblies with said edges extending parallel and spaced apart to define a first pair of edges, at least one module means for mounting thereon at least one preselected component for an electrical circuit, said module means having a second pair of edges spaced apart further than said first pair of edges, means for releasably attaching each said module means between said panel assemblies including grooves in the edges of one of said first and second pairs of edges, said grooves having a spacing for receiving the other of said first and second edges whereby said module means is positionable between said panel assemblies and spring means in at least one of said grooves for biasing said module means towards one of said panel assemblies, and a plurality of terminal means mounted on each of said panel assemblies for releasably receiving and electrically contacting wires for constructing electrical circuits.

2. A modular breadboard assembly, as set forth in claim 1, wherein a plurality of said terminal means are mounted on each of said at least one module means.

3. A modular breadboard assembly on which electrical circuits are constructed comprising, in combination, a pair of panel assemblies, said panel assemblies each having a fixed module receiving groove extending along an edge, means rigidly mounting said panel assemblies with said grooves extending parallel, spaced apart and directed towards each other, at least one module means for attachment between said panel assemblies to extend between and be releasably received by said grooves, said module means including means for mounting thereon at least one preselected component for an electrical circuit, biasing means in at least one of said grooves for biasing said module means towards the groove on the other panel assembly, and a plurality of terminal means mounted on each of said panel assemblies for releasably receiving and electrically connecting wires for constructing electrical circuits.

4. A modular breadboard assembly, as set forth in claim 3, wherein said mounting means includes two elongated leg brackets each having first and second ends, means attaching the first ends of said leg brackets to one of said panel assemblies with said leg brackets extending parallel from such one panel assembly, and means attaching the second ends of said leg brackets to the other of said panel assemblies.

5. A modular breadboard assembly, as set forth in claim 4, wherein said leg brackets include means for stacking a plurality of said breadboard assemblies.

6. A modular breadboard assembly, as set forth in claim 3, wherein a plurality of said terminal means are also mounted on said module means.

7. A modular breadboard assembly, as set forth in claim 3, wherein each of said panel assemblies includes first and second rectangular boards formed from a rigid, electrically insulating synthetic resinous material, said boards each having generally flat sides, means attaching said first and second boards together to form a generally flat rectangular shaped panel assembly, said module receiving groove extending along an edge of said panel assembly between said first and second boards, means for forming a plurality of passages in said panel assembly to extend between said first and second boards and perpendicular to said module receiving groove, and wherein said biasing means includes a plurality of finger means mounted in said passages for limited movement perpendicular toward and away from said module receiving groove, and spring means for biasing each of said finger means toward said module receiving groove.

8. A modular breadboard assembly, as set forth in claim 7, and further including electrically conductive means positioned between said first and second boards on each panel assembly for electrically shielding one side of a circuit constructed on said modular breadboard assembly.

* * * * *